US009486660B2

(12) United States Patent
Hoole

(10) Patent No.: US 9,486,660 B2
(45) Date of Patent: Nov. 8, 2016

(54) FLAT ROW EXERCISE MACHINE

(71) Applicant: Richard J. Hoole, New Smyrna Beach, FL (US)

(72) Inventor: Richard J. Hoole, New Smyrna Beach, FL (US)

( * ) Notice: Subject to any disclaimer, the term of this patent is extended or adjusted under 35 U.S.C. 154(b) by 138 days.

(21) Appl. No.: 13/950,179

(22) Filed: Jul. 24, 2013

(65) Prior Publication Data

US 2014/0274584 A1 Sep. 18, 2014

Related U.S. Application Data

(63) Continuation-in-part of application No. 13/840,168, filed on Mar. 15, 2013, now Pat. No. 9,028,380.

(51) Int. Cl.

| | |
|---|---|
| ***A63B 21/08*** | (2006.01) |
| ***A63B 21/04*** | (2006.01) |
| ***A63B 21/055*** | (2006.01) |
| ***A63B 21/06*** | (2006.01) |
| ***A63B 23/12*** | (2006.01) |
| *A63B 23/035* | (2006.01) |
| *A63B 71/06* | (2006.01) |
| *A63B 21/00* | (2006.01) |

(52) U.S. Cl.

CPC ..... *A63B 21/0421* (2013.01); *A63B 21/0552* (2013.01); *A63B 21/0615* (2013.01); *A63B 23/03541* (2013.01); *A63B 23/1209* (2013.01); *A63B 21/00065* (2013.01); *A63B 21/00069* (2013.01); *A63B 21/4029* (2015.10); *A63B 23/03525* (2013.01); *A63B 2071/0652* (2013.01); *A63B 2210/50* (2013.01)

(58) Field of Classification Search

CPC ..... A63B 21/00087; A63B 21/0009; A63B 21/0012; A63B 21/00123; A63B 21/00127; A63B 21/02; A63B 21/04; A63B 21/0407; A63B 21/0414; A63B 21/0615; A63B 21/1457; A63B 21/1461; A63B 21/1496; A63B 23/03516; A63B 23/03541; A63B 23/1209; A63B 69/06; A63B 2069/064; A63B 2069/066; A63B 2208/0257

USPC ..... 482/51, 72, 92–94, 97–104, 121–123, 482/129–130, 133–136, 139, 142–144

See application file for complete search history.

(56) References Cited

U.S. PATENT DOCUMENTS

| | | | | |
|---|---|---|---|---|
| 3,822,599 A * | 7/1974 | Brentham | ..... | 482/113 |
| 4,357,010 A * | 11/1982 | Telle | ..... | 482/97 |
| 4,492,375 A * | 1/1985 | Connelly | ..... | 482/138 |
| 5,116,297 A * | 5/1992 | Stonecipher | ..... | 482/97 |
| 5,135,449 A * | 8/1992 | Jones | ..... | 482/72 |

(Continued)

*Primary Examiner* — Loan H Thanh
*Assistant Examiner* — Gary D Urbiel Goldner
(74) *Attorney, Agent, or Firm* — Matthew G. McKinney, Esq.; Allen, Dyer, Doppelt, Milbrath & Gilchrist, P.A.

(57) ABSTRACT

A flat row exercise machine is disclosed. The machine includes a base structure, a pair of front and rear vertical frame members fixed to the base structure and extending upwardly therefrom, and a horizontal member fixed between the pair of rear vertical frame members. The machine also includes a pair of levers having upper ends coupled pivotally to the horizontal member and each lever having a lower end configured to hold at least one removable weight or a tension band, where the pair of levers are configured to move independently of each other. A pair of arms extend outwardly from the lower ends of the pair of levers, where each arm is configured to be raised by a user such that the upper ends of the pair of levers pivot in place as the user moves a distal end of the pair of arms in an up and down motion.

18 Claims, 10 Drawing Sheets

(56) References Cited

U.S. PATENT DOCUMENTS

| | | | | |
|---|---|---|---|---|
| 5,211,614 | A * | 5/1993 | Henes | 482/102 |
| 6,482,139 | B1 * | 11/2002 | Haag | 482/121 |
| 7,070,543 | B1 * | 7/2006 | Rindfleisch | 482/97 |
| 7,104,936 | B2 * | 9/2006 | Karlstrom | 482/137 |
| 7,530,936 | B1 * | 5/2009 | Hall | 482/142 |
| 7,575,538 | B1 * | 8/2009 | Clark | 482/103 |
| 7,608,020 | B2 * | 10/2009 | Mason | 482/97 |
| 7,976,439 | B2 * | 7/2011 | Abelbeck | 482/93 |
| 8,172,731 | B1 * | 5/2012 | Bredda | 482/94 |
| 2002/0119871 | A1 * | 8/2002 | Fulks | 482/93 |
| 2003/0134722 | A1 * | 7/2003 | Greenland | 482/100 |
| 2003/0134723 | A1 * | 7/2003 | Greenland | 482/104 |
| 2006/0063650 | A1 * | 3/2006 | Francis | 482/94 |
| 2007/0155595 | A1 * | 7/2007 | Rogers et al. | 482/94 |
| 2007/0155596 | A1 * | 7/2007 | Rogers et al. | 482/97 |
| 2014/0057767 | A1 * | 2/2014 | Henniger et al. | 482/142 |

* cited by examiner

FIG. 6
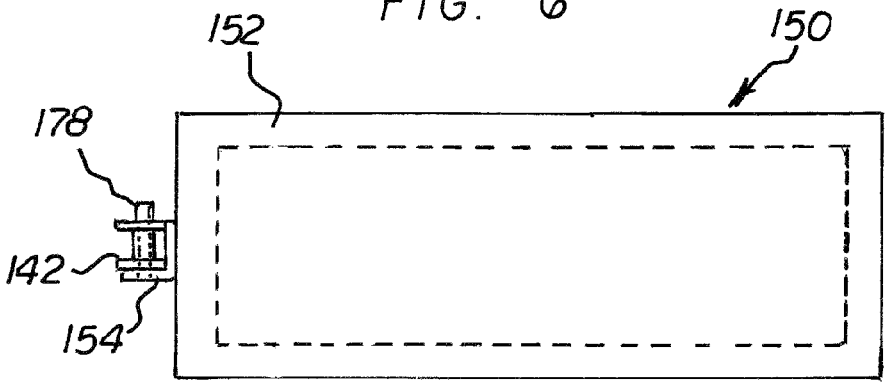
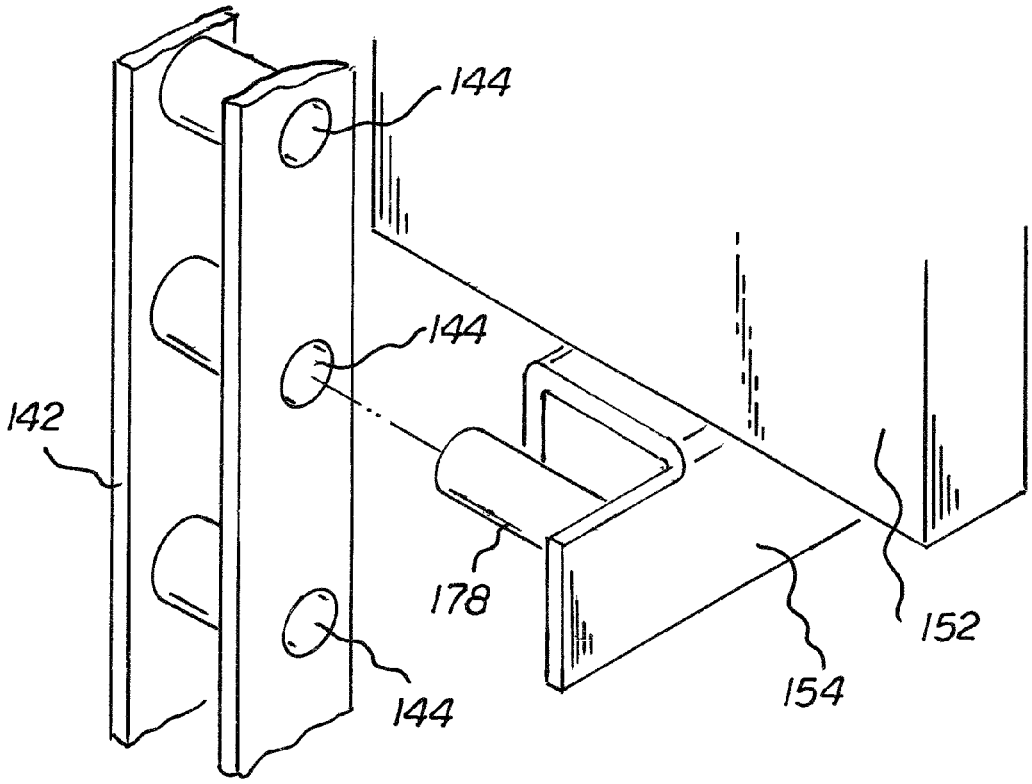
FIG. 7

FIG. 8
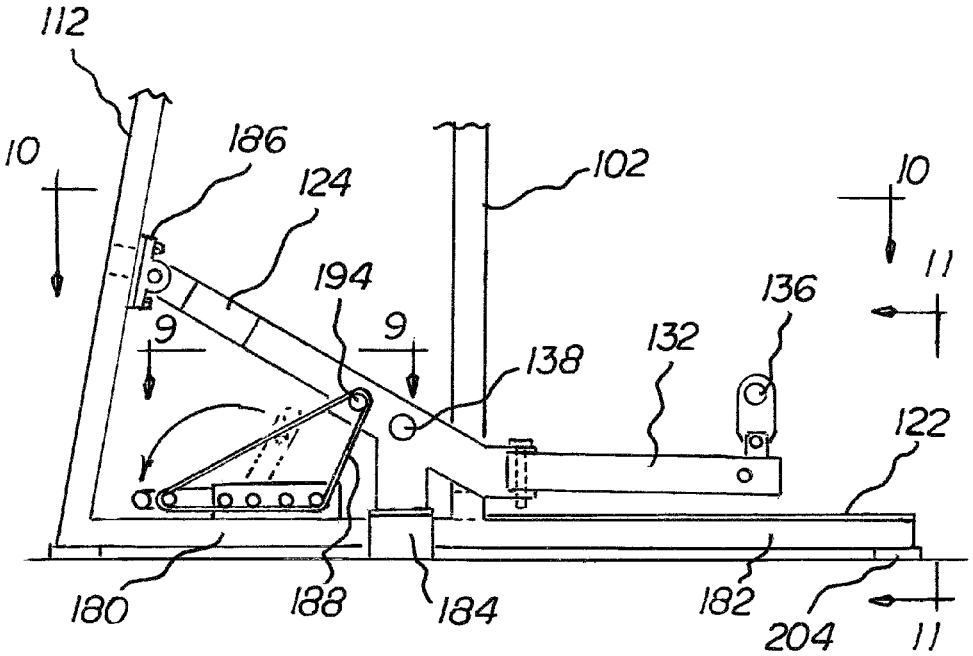
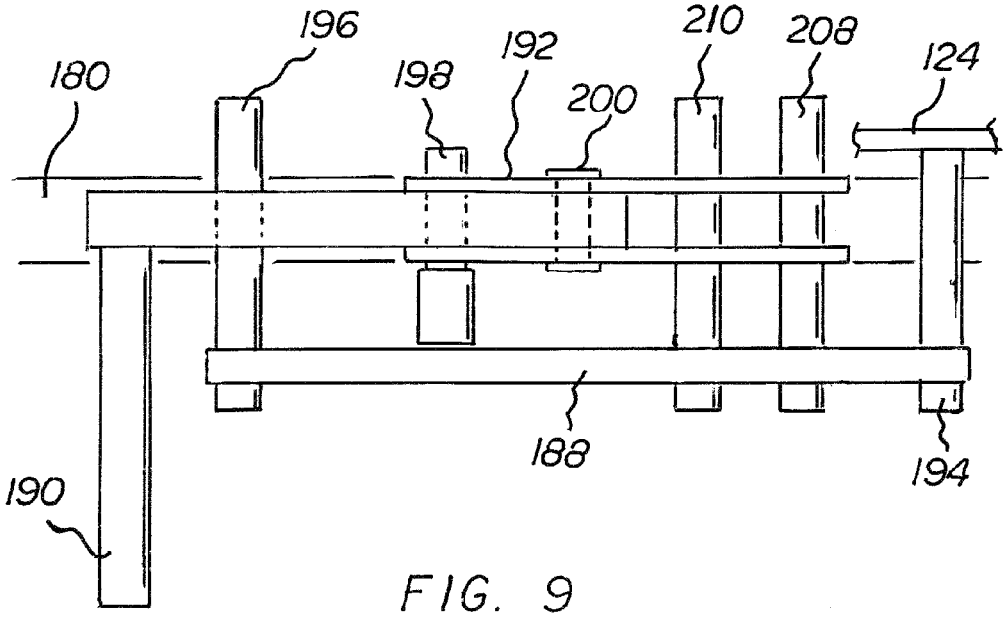
FIG. 9

FIG. 10
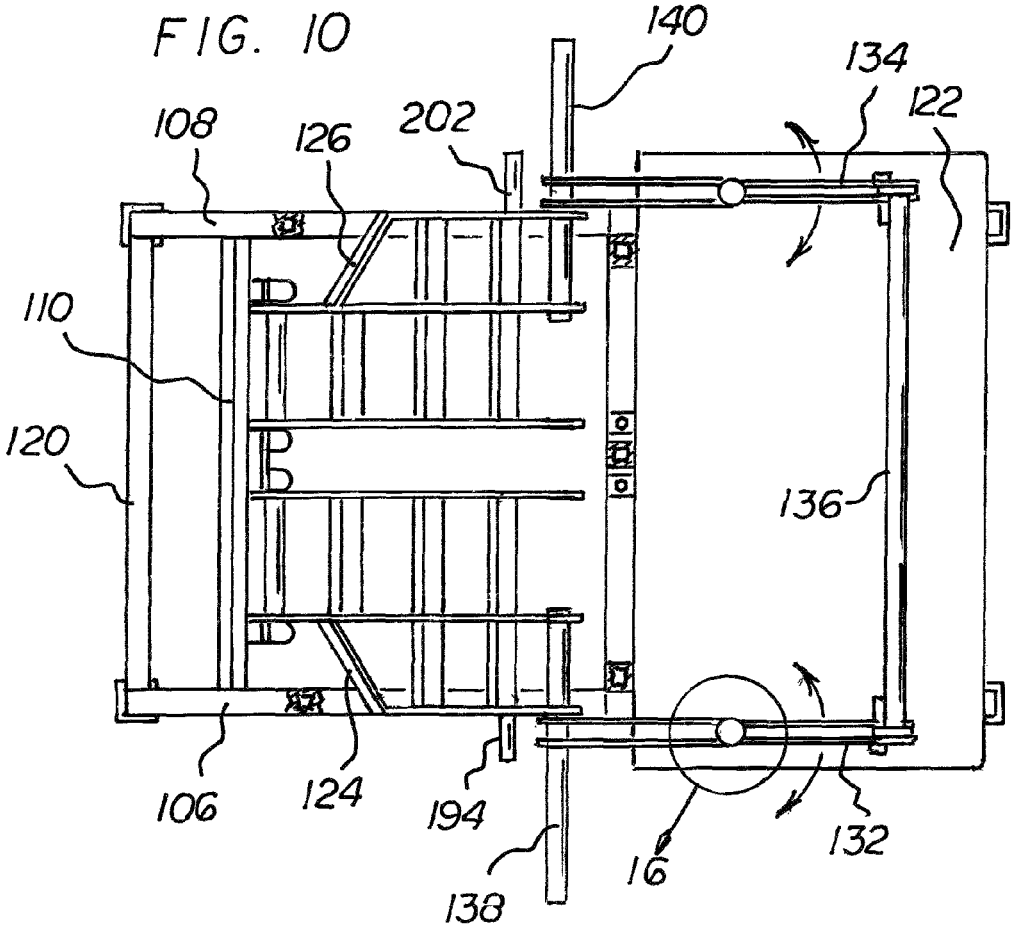
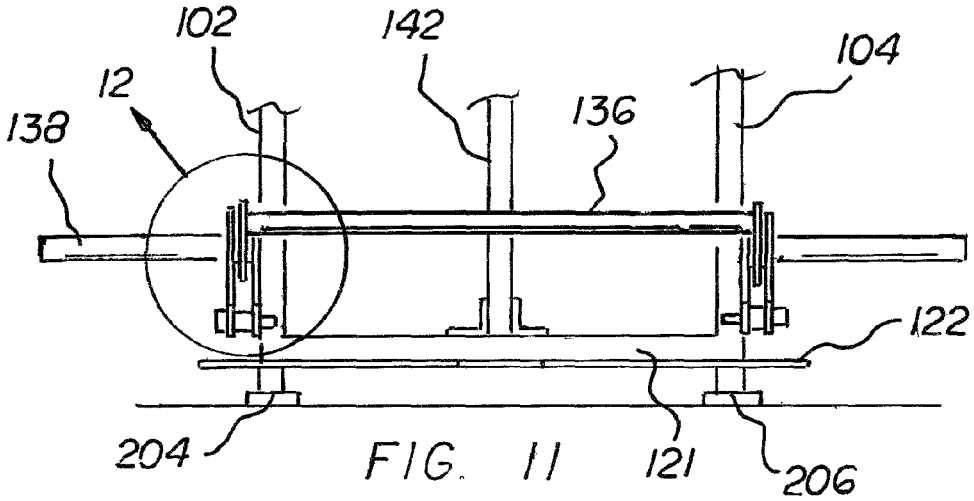
FIG. 11

FIG. 15
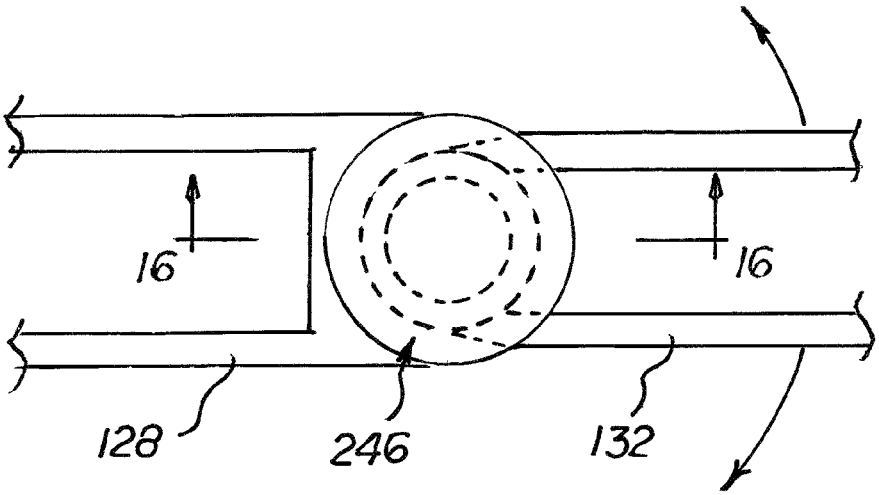
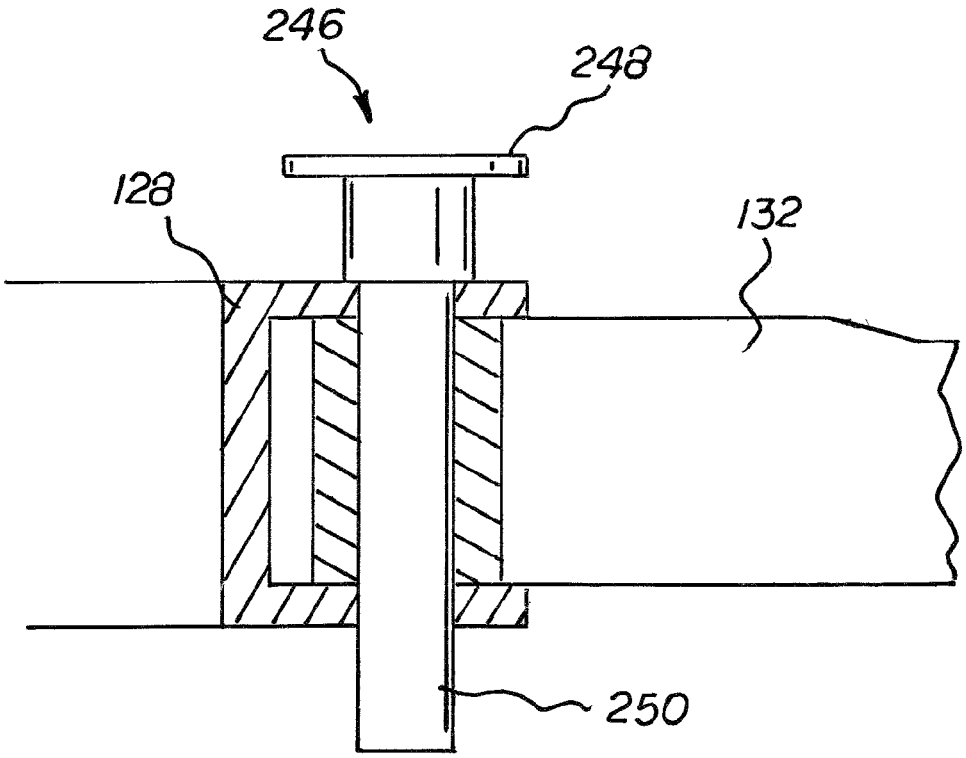
FIG. 16

FLAT ROW EXERCISE MACHINE

I. CROSS REFERENCE TO RELATED APPLICATIONS

This application is a continuation-in-part of pending U.S. patent application Ser. No. 13/840,168 filed Mar. 15, 2013.

II. FIELD

The present disclosure is generally related to flat row exercise equipment.

III. DESCRIPTION OF RELATED ART

Rowing type exercises are used for primarily working out the back muscles. These rowing exercises can be difficult for many people to perform using free weights because the exercises require balance and coordination as well as strength to follow the proper movement path. Free rowing exercises require bending at the waist, which is undesirable. Improper form can make the exercise more difficult and may lead to possible injury.

Various exercise machines have been developed for performing rowing and other exercises. One particular type uses a stationary user support and others have a pivoting or movable user support, which may be connected to the exercise arm or user engagement device. A shortcoming of the existing exercise machines is the unnatural and exaggerated arcing movement found in pivoting arm exercise machines, which do not accurately simulate the natural body movement that is accomplished when using free weights.

In addition, current exercise machines with pivoting or movable user supports often do not maintain proper positioning of the user throughout the exercise motion. Also, they have awkward hand or wrist positions and implement exaggerated and unnatural arcing movements. Instead, what is needed in the art is an exercise machine that uses smaller elliptical movements that are associated with free weights or natural exercise movements. Further, there is no provision for proper positioning of the user relative to the position of the user engaging the exercise arm throughout the entire exercise motion. Often, an awkward starting or finishing position is required, potentially causing strain or injury.

Accordingly, what is needed in the art is flat row exercise equipment that allows a user to perform flat row exercises with the natural movement of free weights but with the safety of equipment to reduce the possibility of injury to the user.

IV. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a flat row exercise machine is disclosed. The machine includes a base structure to engage a substantially horizontal surface, a pair of front vertical frame members that are fixed to the base structure and extend upwardly therefrom, where the front vertical frame members being substantially parallel to one another. In addition, a pair of rear vertical frame members are fixed to the base structure and extend upwardly therefrom, where the rear vertical frame members being substantially parallel to one another, and a horizontal member connected between the pair of rear vertical frame members. The machine also includes a pair of levers having upper ends coupled pivotally to the horizontal member and each lever having a lower end configured to hold at least one removable weight, a tension band, or any combination thereof, where the pair of levers are configured to move independently of each other. A pair of arms extend outwardly from the lower end of the pair of levers, where each arm is configured to be raised by a user such that the pair of levers resist the user raising the pair of arms.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

Figure 1:
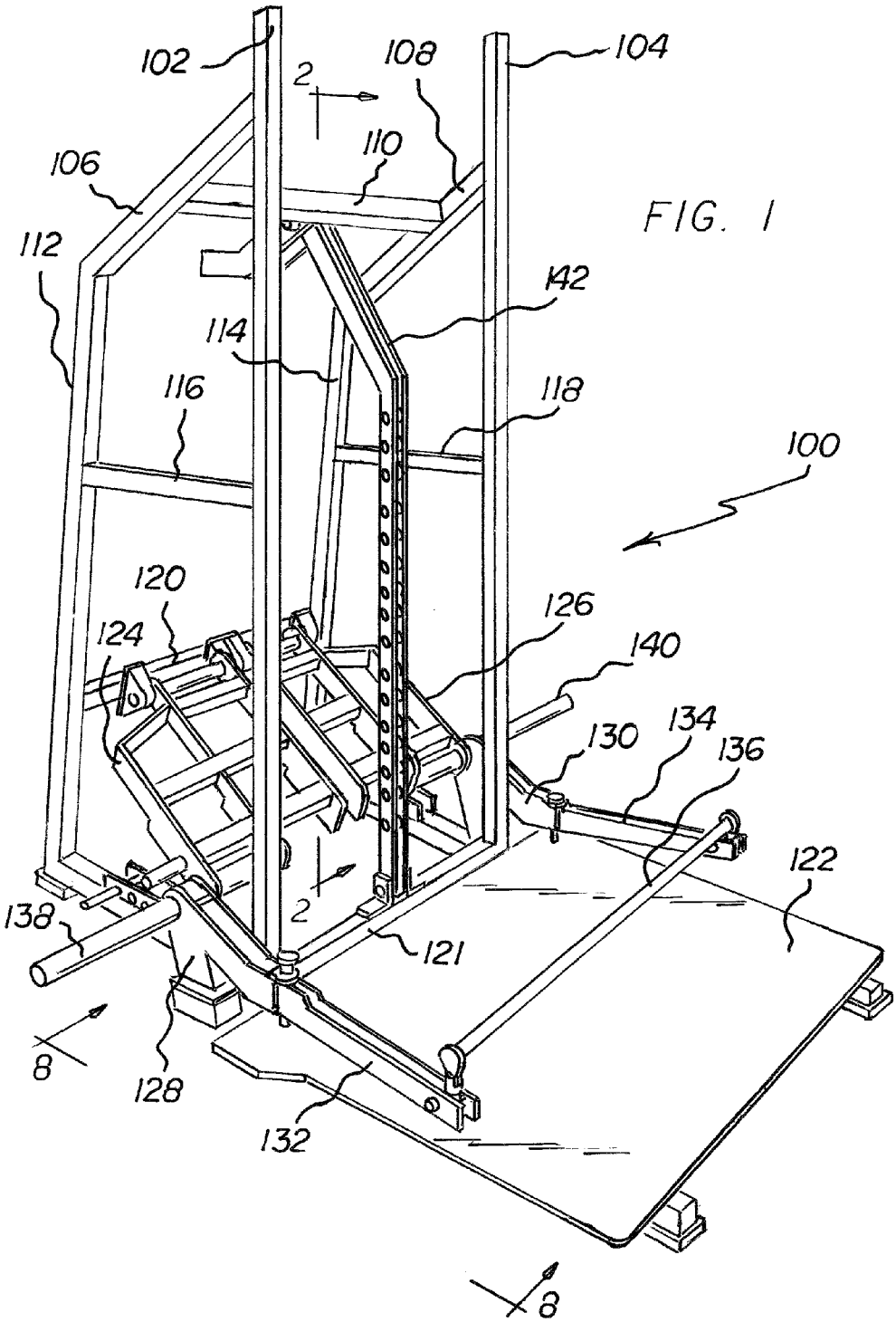
FIG. 1 is a perspective view of a particular illustrative embodiment of flat row exercise machine.
Figures 2, 3:
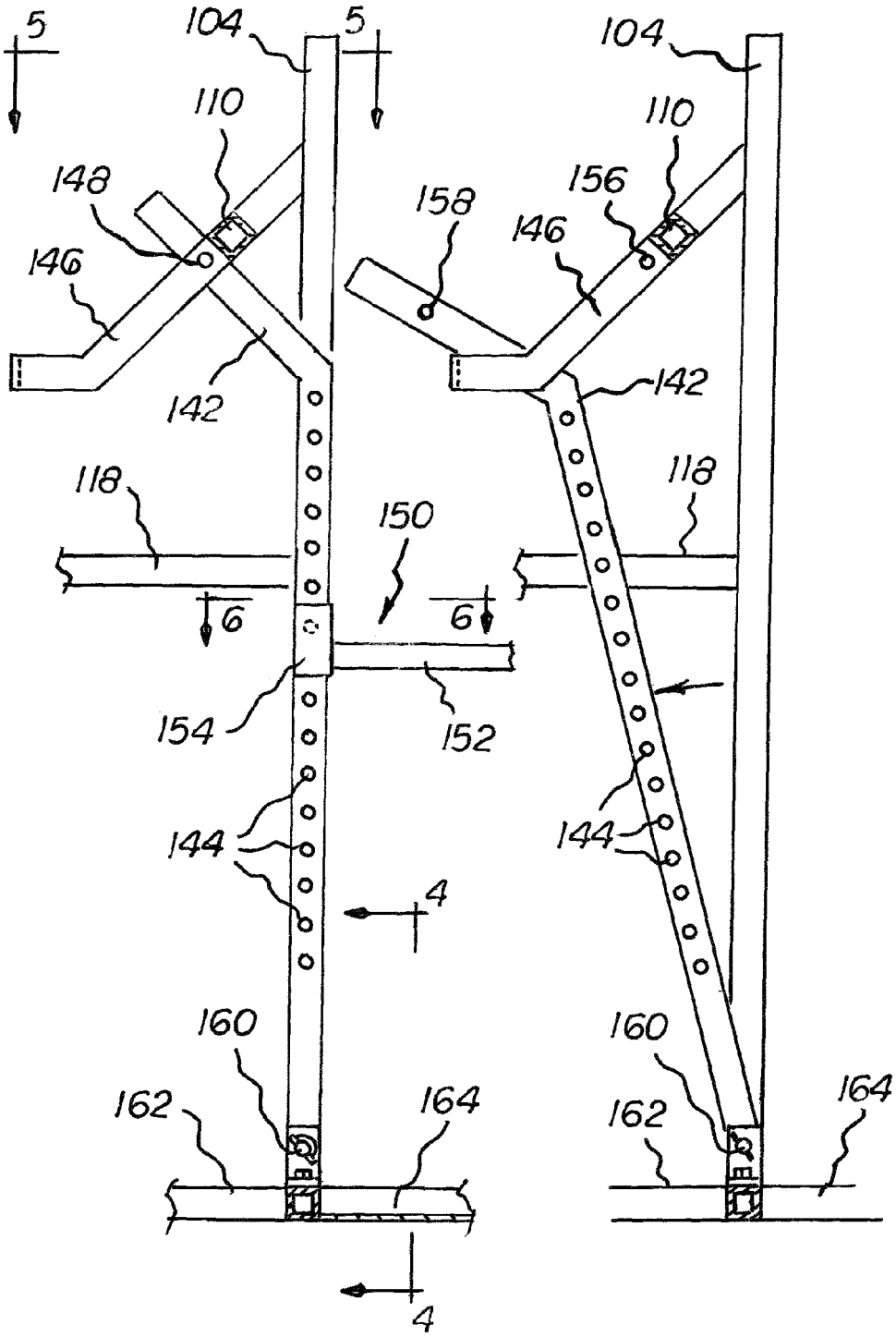
FIG. 2 is an elevational view of a center bench support and bench taken in the direction of line 2-2 in FIG. 1.
FIG. 3 is an elevational view of the center bench support shown in FIG. 2 moved to a storage position with the bench removed.
Figure 4:
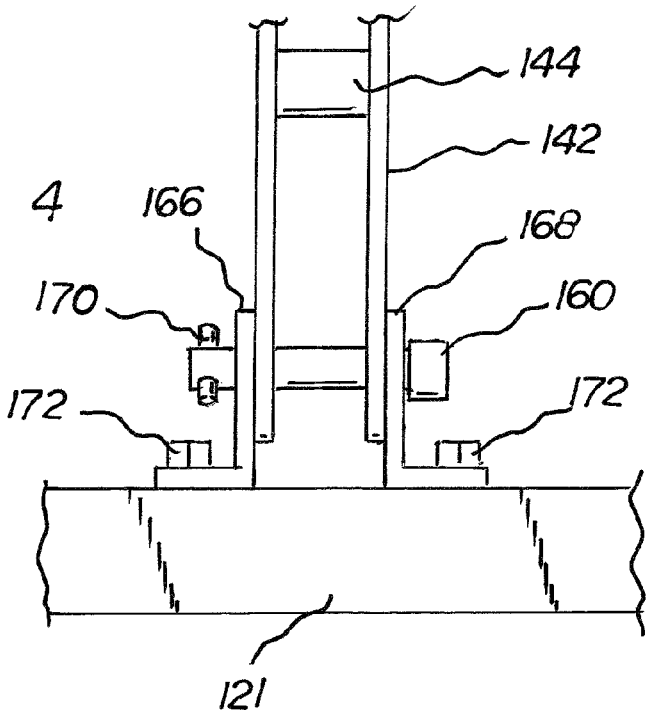
Figure 5:
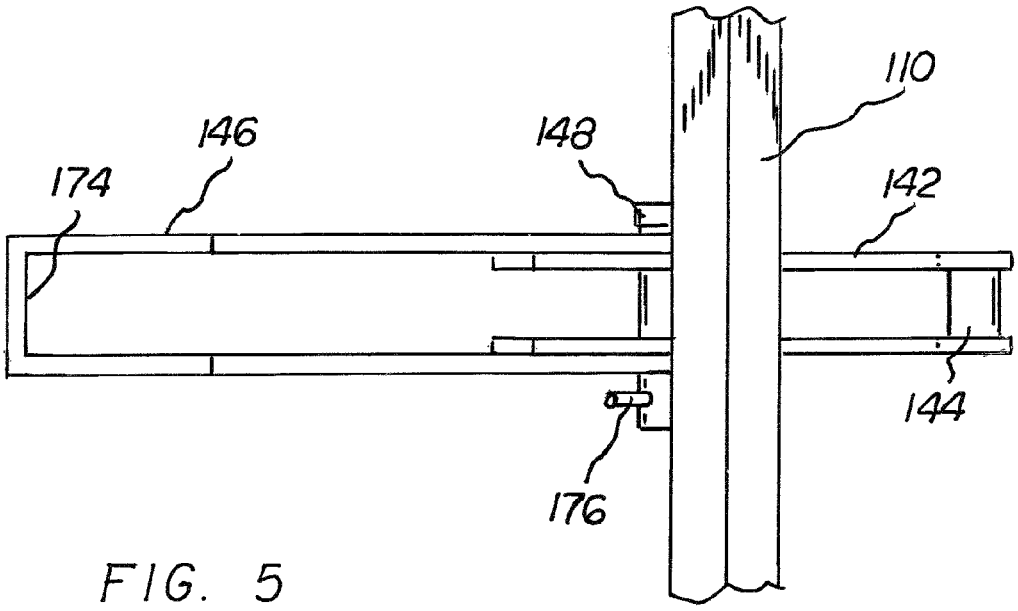
Figure 12:
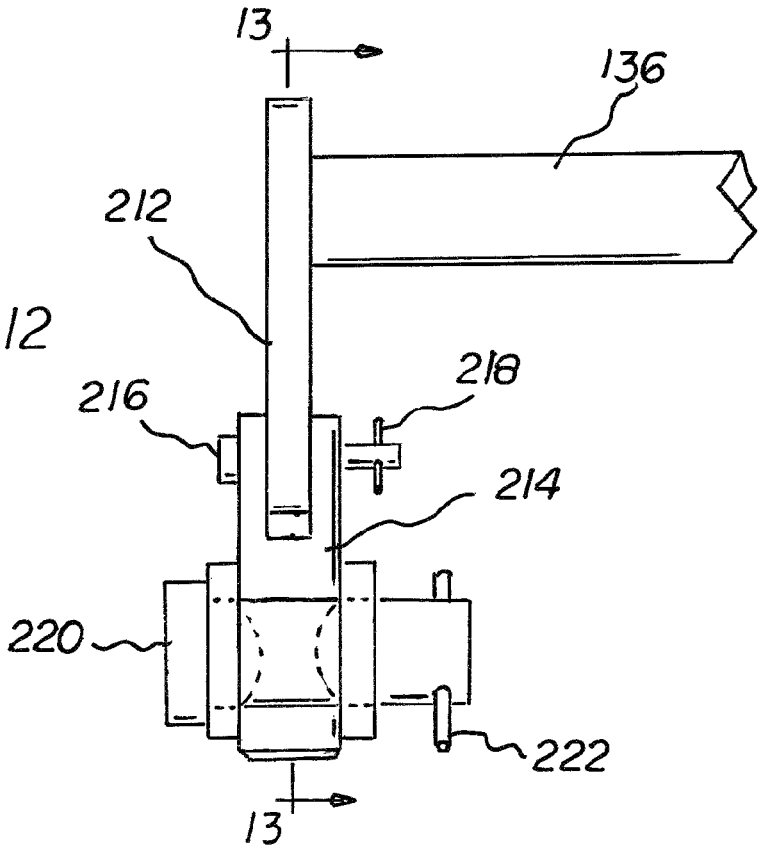
Figure 13:
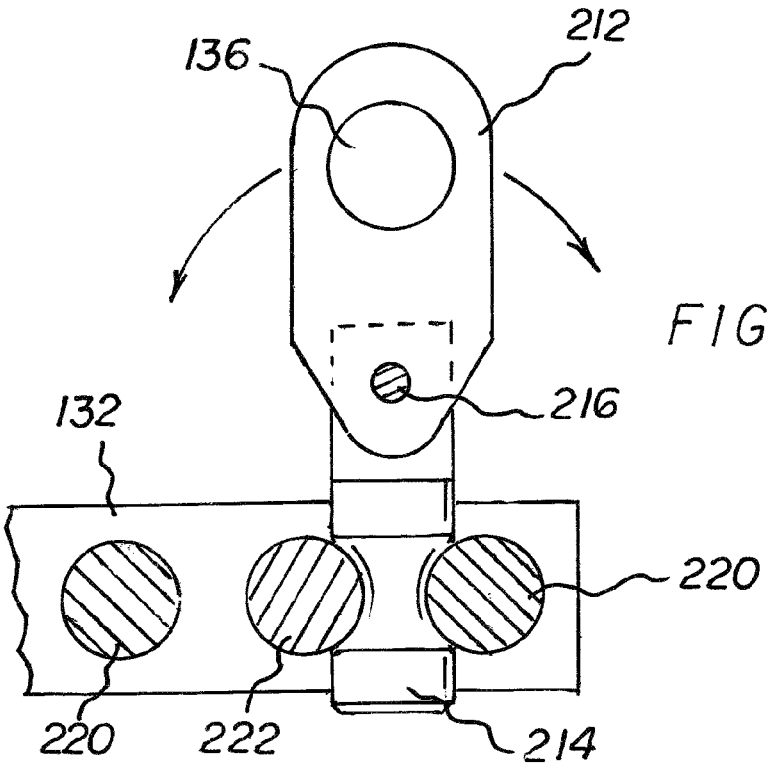
Figure 14:
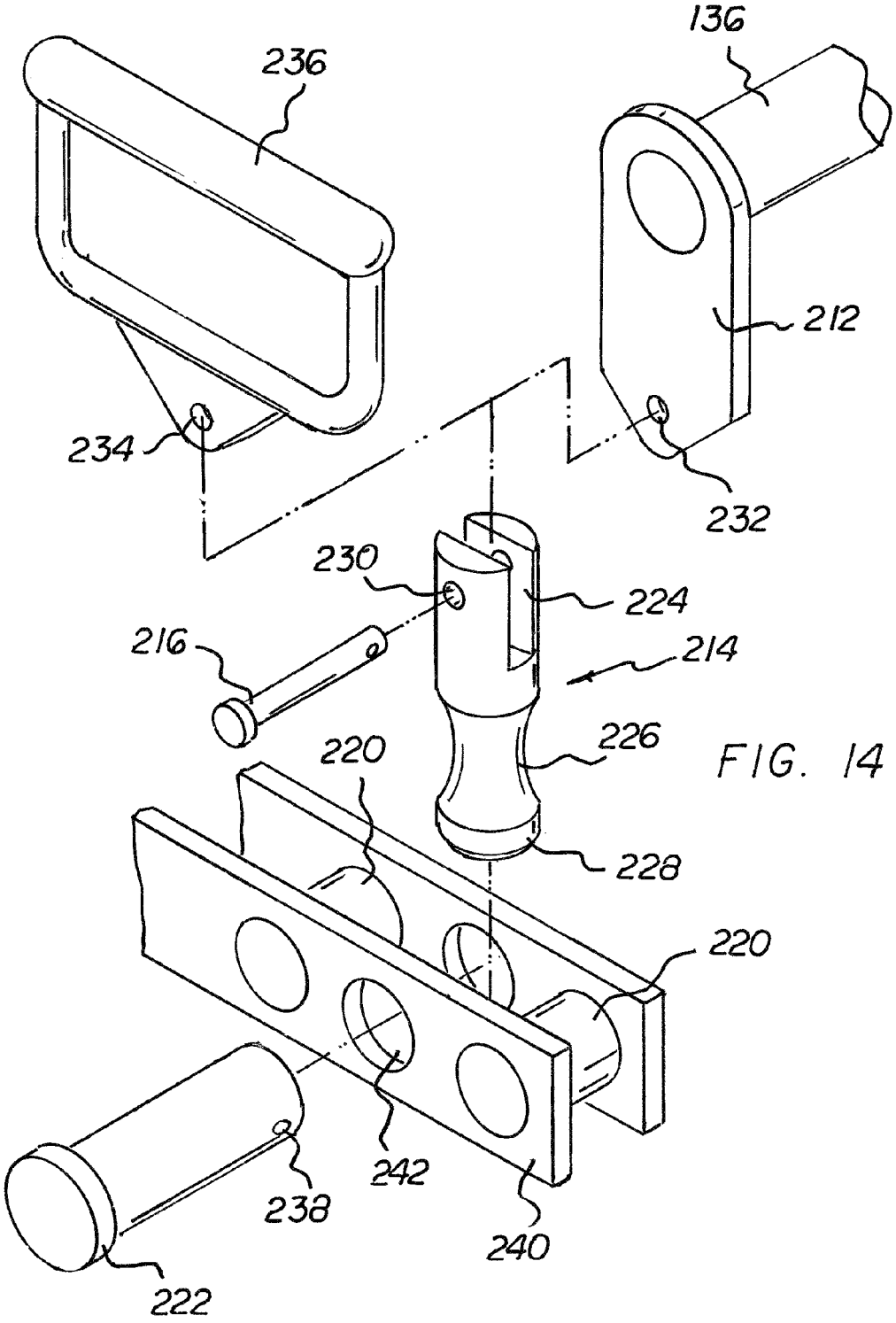
Figure 17:
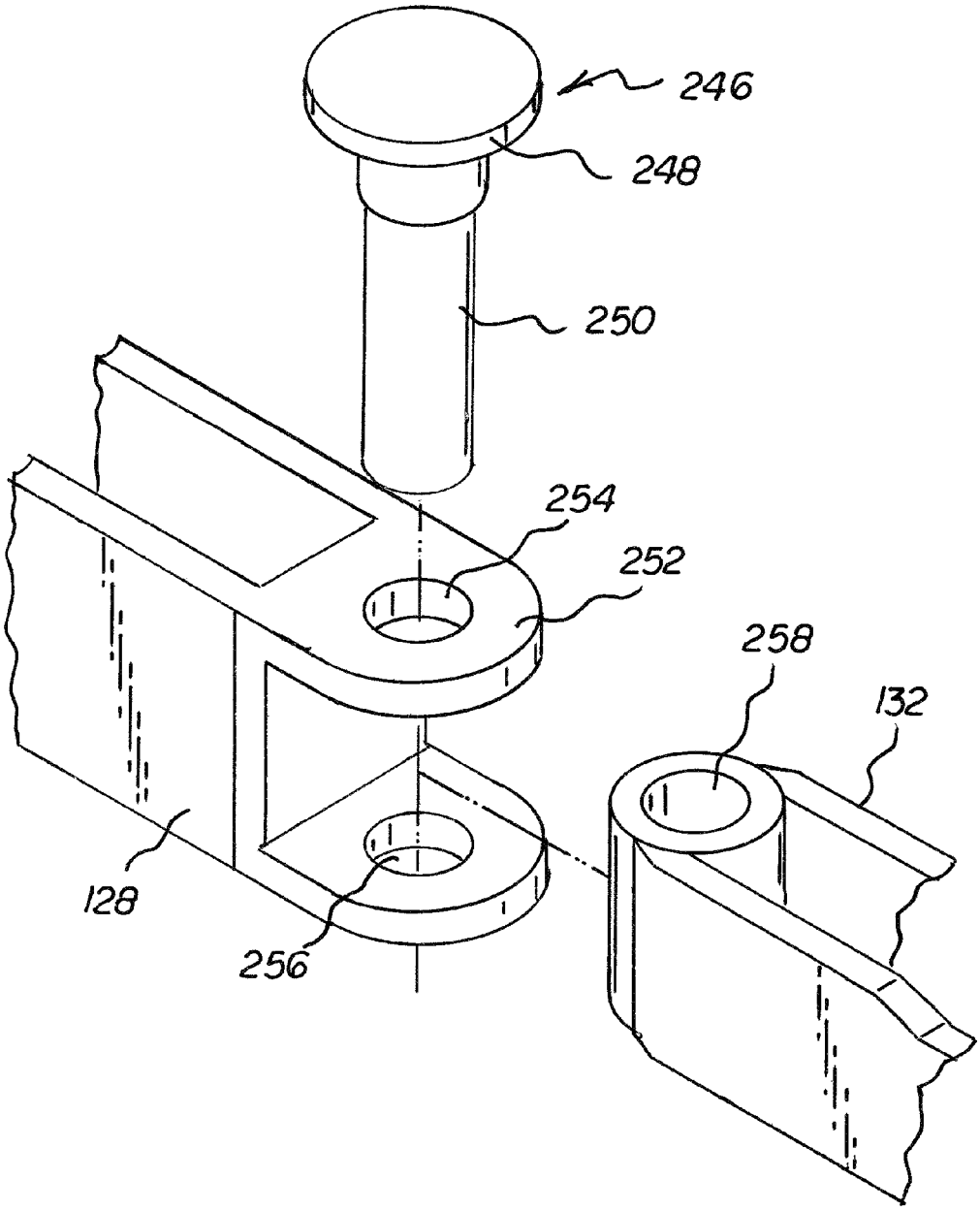

FIG. 4. is a front view of a connection between the center bench support and a base structure taken in the direction of line 4-4 in FIG. 2;

FIG. 5 is a top view of an attachment of the center bench support to an upper cross member taken in the direction of line 5-5 in FIG. 2;

FIG. 6 is a top view of the bench secured to the center bench support taken in the direction of line 6-6 in FIG. 2;

FIG. 7 is a partial perspective view illustrating the attachment and interconnection of the center bench support and the bench;

FIG. 8 is a partial left side elevational view of the flat row exercise equipment taken in the direction of line 8-8 in FIG. 1 illustrating the installation of a tension band;

FIG. 9 is a top elevational view of the tension band taken in the direction of line 9-9 in FIG. 8;

FIG. 10 is a top elevational view of the flat row exercise equipment;

FIG. 11 is a partial front view of the flat row exercise equipment;

FIG. 12 is a detail view of the attachment and interconnection of an exercise bar shown in FIG. 11;

FIG. 13 is a partial elevation view of the attachment of the exercise bar taken in the direction of line 13-13 in FIG. 12;

FIG. 14 is a partially exploded, fragmentary perspective view of the attachment of the exercise bar or handgrips to the flat row exercise equipment;

FIG. 15 is a partial top view of a horizontal hinge pin for rotation of an arm of the flat row exercise equipment in the horizontal plane;

FIG. 16 is a cross-sectional view taken in the direction of line 16-16 in FIG. 15; and FIG. 17 is a partially exploded, fragmentary perspective view of the horizontal pin attachment.

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Referring now to FIG. 1, an exemplary embodiment of a flat row exercise machine is disclosed and generally designated 100. A left front vertical frame member 102 and a right front vertical frame member 104 are fixed to a base structure and extend upwardly from the base structure. In addition, the front vertical frame members 102, 104 are substantially parallel to one another.

An upper left strut 106 is fixed to a left rear vertical frame member 112 and similarly, an upper right strut 108 is fixed to a right rear vertical frame member 114. The struts 106, 108 are substantially parallel to one another and angle upwards from the rear vertical frame members 112, 114 up to the front vertical frame members 102, 104. The pair of rear vertical frame members 112, 114 are substantially parallel to one another. A left side member 116 connects the left front vertical frame member 102 to the left rear vertical frame member 112. Similarly, a right side member 118 connects the right side front vertical frame member 104 to the right rear vertical frame member 114. An upper front cross member 110 connects the upper left strut 106 to the upper right strut 108. A lower rear cross member 120 spans between and connects the pair of rear vertical frame members 112, 114.

The flat row exercise machine 100 includes a left lever 124 and a right lever 126. The pair of levers 124, 126 have upper ends which are coupled pivotally to the lower rear cross member 120. Each lever 124, 126 includes a lower end that is configured to hold at least one removable weight, a tension band, or any combination thereof. The pair of levers 124, 126 are configured to move independently of each other so that the user has the feeling during the exercise similar to using free weights. A weight peg 138, 140 is fixed to the lower end of each lever 124, 126 for loading a free weight.

A pair of arms 132, 134 extend outwardly from a respective lower end of the pair of levers 124, 126. Each arm 132, 134 has a distal or free end that is configured to be raised by a user such that resistance is felt by the user as the user raises the pair of arms 124, 126 in an up and down motion. The resistance may be provided by free weights loaded on the levers 124, 126 using the weight pegs 138, 140 or through resistance bands secured to the levers 124, 126 and an anchor point on the exercise machine 100. An elbow 128, 130 of each of the arms 132, 134 is fixed to the respective lever 124, 126 and is configured to support the lower end of the lever 124, 126 to provide a stop or rest at the lower range of motion.

A bar 136 can be secured to each distal end of the arms 132, 134, or handgrips can be used so that the arms 132, 134 move completely independent from the other. As described above, the levers 124, 126 move independently of each other similar to using free weights so that even when a bar 136 is connected to the arms, each arm 132, 134 may move at different speeds and levels as the bar 136 is raised by the user. This is an advantage over existing machines where both right and left sides move at the same speed because they are connected together rather than moving independently. Thus, one side of the user's body may compensate for the weaker side instead of strengthening. A platform 122 may be provided for the user to stand when approaching and moving into position to begin exercising. The platform 122 extends under the arms 132, 134 and outward away from the levers 124, 126.

A center bench support 142 extends upwards from a front base cross member 121. The center bench support 142 includes a series of adjustment holes 144, where the center bench support 142 is configured to removably receive and support a cantilevered bench assembly 150 above the pair of arms 132, 134 at a desired height as best illustrated in FIG. 2. The bench assembly 150 includes a flange 154 that is configured to engage the center bench support 142. The user will lay face down and place his chest on the bench 152 for support and the height of the bench 152 is placed based on the user's arm length. In addition, an upper portion of the center bench support 142 is angled rearward so that the center bench support 142 slides between a U-shaped collar 146 that is cantilevered rearward from the upper front cross member 110. A pin 148 is slid through a collar aperture 156 and center support aperture 158 that is disposed on an upper portion of the center bench support 142 to secure the center bench support 142 to the U-shaped collar 146 in the upright position.

In use, the bench assembly 150 is removably secured in place above the pair of arms 132, 134. The bench 152 is configured to be set at a desired height above the pair of arms 132, 134 so that user can lay on his chest face down and reach down to grasp the bar 136 (or handgrips 236) and move the arms 132, 134 in an up and down motion under resistance.

The center bench support 142 is pivotally secured at its lower end to the base cross member 121 using pin 160 and configured to pivot from the upright position to a leaning back position to move it out of the way so that the user can perform free standing rowing exercises without bumping his/her head on the center bench support 142. Also shown in FIGS. 2 and 3 is a right side base support 162 and right side platform support 164 that engage a horizontal surface and provide a foundation for the machine 100. The left side of the machine 100 has similar foundation members.

A detail of a front elevational view of the connection of the center bench support 142 to the base cross member 121 is illustrated in FIG. 4. A left angle bracket 166 and a right angle bracket 168 are secured to the base cross member 121 using bolts 172. The lower portion of the center bench support 142 slides between the brackets 166, 168 and the pin 160 pivotally secures the center bench support 142 to the base cross member 121. A cotter pin 170 secured the pin 160 in place.

A top view of the center bench support 142 is illustrated in FIG. 5. The center bench support 142 is secured in the upright position adjacent to the upper front cross member 110 using bolt 148. A cotter pin 176 may be used to secure the pin 148 in place. When the center bench support 142 is leaned back out of the way, it rests against a rear portion 174 of the U-shaped collar 146.

Referring now to FIGS. 5 and 6, the bench assembly 150 is illustrated. The bench assembly 150 includes the bench 152 for a user to place his chest on during exercising. In addition, the bench assembly 150 includes the flange 154, which extends perpendicular to bench 152. The flange 154 having a bench pin 178 that is perpendicular to the flange 154. The flange 154 is configured so that the bench pin 178 will slide into a desired adjustment hole 144 and the flange rests adjacent to the center bench support 142. To install the bench assembly, the bench 152 is moved into a vertical position and the bench pin 178 is slid into the desired hole 144. The bench 152 is then rotated downward until in a horizontal position to lock the bench assembly 150 in place. The steps are reversed to remove the bench assembly 150 from the center bench support 142.

FIGS. 8 and 9 illustrate the use of a resistance band 188 with the flat row exercise machine 100. A handle 190 is used to allow the user to place tension in the resistance band 188 by rotating between an up position and a down and locked position about pivot pin 200. In use, a first end of the resistance band 188 is placed over peg 194 that is fixed to the left lever 124 and a second end of the resistance band 188 is looped over pin 196. The resistance band 188 is also sequentially looped around either fixed pin 208 or 210 that are secured through channel 192. The user rotates the handle 190 downward causing the resistance band 188 to stretch and be placed in tension. Once the handle 190 is pushed all the way down, then locking pin 198 is inserted through the channel 192 to keep the handle 190 in the down position and the resistance band 188 under tension. Accordingly, when the user raises the left arm 132, peg 194 that is fixed to the left lever 124 is also raised causing the resistance band 188 to stretch and resist the movement. The right side of the machine 100 operates similarly.

The channel 192 is installed on base support 180. Although the resistance band 188 is shown as a loop, the resistance band 188 can also be a single length secured between the peg 194 and the base support 180. In operation, the user would stand on the platform 122 or rest on the bench 152, and move against the tension of the resistance band 188 by moving the arms 132, 134 upwards. Any number of resistance bands 188 may be used, where more bands 188 increases the resistance and more strength is required to install the bands 188 and place under tension. Thus, using the handle 190 to add and remove the resistance bands 188 is easy by using a mechanical advantage.

The handle 190 is shown in the down and locked position. The locking pin 198 has been inserted. Thus, the handle 190 will remain in the locked position allowing the resistance band 188 to be used under significant tension. The tension band 188 has been stretched to increase the resistance to the user during exercising. The pivot pin 200 acts a fulcrum so that the force needed to overcome the load imparted by the resistance band 188 is reduced. It is relatively impossible, if not impossible, to stretch the resistance band 188 by hand to the tension levels that the handle 190 can achieve due to its mechanical advantage. A similar handle 190 and tension band 188 may be used on the opposing side of the machine 100.

Referring now to FIGS. 10 and 11, the relative position of the levers 124, 126 to the arms 132, 134 is illustrated. The bar 136 is installed to the arms 132, 134 and the machine 100 is ready to be loaded with free weights on pegs 138, 140 or with resistance bands 188 as explained above. Both the left arm 132 and the right arm 134 are configured to rotate in a horizontal plane as the user raises the bar 136 so that the user must utilize additional coordination to lift the arms 132, 134 in a controlled and steady motion without swaying side to side. The mechanism that allows the arms 132, 134 to move in the horizontal plane is shown in FIG. 16 and described below. The platform 122 is also elevated off the ground using base feet 204, 206.

In addition, the attachment and interconnection of the bar 136 to the arms 132, 134 allows the bar 136 to rotate in a vertical plane. This freedom of motion of the bar 136 requires the user to utilize additional coordination to move the bar 136 in a controlled and steady motion that is similar to that when using free weights such as dumbbells.

The connection of the bar 136 to the left side arm 132 is shown in FIGS. 12-14, where the right side is similar. The bar 136 includes a bar connector 212 that secures the bar 136 to the distal end of the arm 132 using a pair of slotted pins 214 to removably secure the bar 136 or the pair of handgrips 236 to the arm 132. The slotted pins 214 allow the bar 136 or pair of handgrips 236 to rotate in both the horizontal plane and a vertical plane relative to the arm 132. The bar connector 212 is slid into the slot 224 of the slotted pin 214 and a connector pin 216 is then used to slide through an aperture 230 that traverses the slot 224 of slotted pin 214 to secure the bar connector 212 to the slotted pin 214. The slotted pins 214 have a lower tapered section 226 that is configured to engage perpendicular positioned bolts disposed on opposing sides of the slotted pin 214. Accordingly, the slotted pin 214 is configured to be lowered down into a channel 240 of the arm 132. Once the tapered section 226 is in the channel 240, removable bolt 222 is slid through aperture 242 and adjacent to the tapered section 226. Another bolt 220 is disposed in the channel on the opposing side of the tapered section 226 so that the slotted pin is pinched in place at the tapered section 226 by removable bolt 222 and bolt 220. In addition, handgrips 236 can be secured to the arms 132, 134 in the same fashion as the bar 136 described above. The handgrips 236 provide more independent movement and require even more coordination by the user to move the arms in a controlled and steady motion. The lower tapered section 226 allows movement in the horizontal plan and the slot 224 allows movement in the vertical plane.

Referring now to FIGS. 15-17, a horizontal hinge pin 246 is disposed at a proximate end of the left side arm 132 (the right side assembly is similar) so that the distal end of the arm 132 can move and rotate in the horizontal plane to provide more movements similar to using free weights. The horizontal hinge pin 246 secures the elbow 128 to the proximate end of the arm 132 so that the distal end of the arm 132 is configured to rotate about the horizontal pin 246. A first end 252 of the elbow 128 includes a pair of apertures 254, 256. The proximate end of the arm 132 includes a cylindrical receiver 258 that is configured to slide between the apertures 254, 256 so that the receiver aligns with the apertures 254, 256 and the barrel 250 of the horizontal hinge pin 246 can traverse both the arm 132 and the elbow 128 until the head 248 is flush with the top 252 of the elbow 128. The connection of the horizontal hinge pin 246 allow movement about its axis to provide an increased range of motion over a fixed connection.

The pair of levers 124, 126 each further include an upper tension pin 194 configured to receive a first end of a tension band 188 thereon, and the base support 180 having a lower tension pin 196 configured to receive a second end of the tension band 188, where the tension band 188 is elastic and configured to resist the user as the user is raising the pair of arms 132, 134.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A flat row exercise machine, the machine comprising:

a base structure to engage a substantially horizontal surface;

a pair of front vertical frame members fixed to the base structure and extending upwardly therefrom;

a pair of rear vertical frame members fixed to the base structure and extending upwardly therefrom;

a horizontal member connected between the pair of rear vertical frame members;

a pair of levers having upper ends coupled pivotally to the horizontal member, wherein the pair of levers are configured to move independently of each other;

an elbow directly disposed at a lower end of each lever of the pair of levers;

a pair of arms, wherein each arm is configured to be raised by a user such that the pair of levers resists the user raising the pair of arms; and a pair of horizontal hinge pins, wherein each horizontal hinge pin directly couples the respective elbow to the respective arm of the pair of arms, and wherein a distal end of each arm is configured to rotate in a horizontal plane about the respective horizontal hinge pin.

2. The flat row exercise machine of claim 1, further comprising a center bench support having a series of adjustment holes, wherein the center bench support is configured to removably receive and support a cantilevered bench above the pair of arms at a desired height.

3. The flat row exercise machine of claim 2, wherein the pair of arms are configured to selectively receive a bar therebetween or a pair of handgrips.

4. The flat row exercise machine of claim 3, further comprising a pair of slotted pins to removably secure the bar or the pair of handgrips to the pair of arms, wherein the bar or pair of handgrips are configured to rotate in both the horizontal plane and a vertical plane relative to the pair of arms.

5. The flat row exercise machine of claim 4, the pair of slotted pins each having a tapered section configured to engage a pair of set pins to secure the slotted pins to the distal ends of the arms.

6. The flat row exercise machine of claim 5, the center bench support pivotally secured at its lower end to the base structure and configured to pivot from an upright position to a leaning back position when the cantilevered bench is not installed.

7. The flat row exercise machine of claim 6, wherein each elbow having a weight peg to receive a free weight thereon.

8. The flat row exercise machine of claim 7, the pair of levers each further comprising an upper tension pin configured to receive a first end of a tension band thereon, and the base structure having a lower tension pin configured to receive a second end of the tension band, wherein the tension band is elastic and configured to resist the user as the user is raising the pair of arms.

9. A flat row exercise machine, the machine comprising:

a base structure;

a plurality of vertical frame members fixed to the base structure and extending upwardly therefrom;

a pair of levers having upper ends coupled pivotally to the vertical frame members and each lever having a lower end;

an elbow directly disposed at a lower end of each lever of the pair of levers;

a pair of arms extending outwardly, wherein a distal end of each arm is configured to be raised independently of the other arm by a user resulting in the respective lever to pivot about its upper end; and a pair of horizontal hinge pins, wherein each horizontal hinge pin directly couples the respective elbow to the respective arm of the pair of arms, and wherein the distal end of each arm is configured to rotate in a horizontal plane about the respective horizontal hinge pin.

10. The flat row exercise machine of claim 9, further comprising a cantilevered bench above the pair of arms, wherein the cantilevered bench is configured to be set at a desired height above the pair of arms so that the user can lay on his chest and reach down to grasp the pair of arms and move the arms in an up and down motion under resistance.

11. The flat row exercise machine of claim 10, wherein the pair of arms are configured to selectively receive a bar therebetween or a pair of handgrips.

12. The flat row exercise machine of claim 11, further comprising a pair of slotted pins to interchangeably secure the bar or the pair of handgrips to the pair of arms, wherein the slotted pins are configured to rotate in the horizontal plane relative to the pair of arms.

13. The flat row exercise machine of claim 12, the pair of slotted pins each having a tapered section configured to engage a pair of set pins to secure the slotted pins to the distal ends of the arms.

14. The flat row exercise machine of claim 13, wherein each elbow having a weight peg to receive a free weight thereon.

15. The flat row exercise machine of claim 14, the pair of levers each further comprising an upper tension pin configured to receive a first end of a tension band thereon, and the base structure having a lower tension pin configured to receive a second end of the tension band, wherein the tension band is elastic and configured to resist the user as the user is raising the pair of arms.

16. The flat row exercise machine of claim 9, further comprising a center bench support having a series of adjustment holes, wherein the center bench support is configured to removably receive and support a cantilevered bench above the pair of arms at a desired height.

17. The flat row exercise machine of claim 16, wherein the pair of levers are configured to move independently of each other or to be locked together to move in unison.

18. A flat row exercise machine, the machine comprising:

a base structure to engage a substantially horizontal surface;

a pair of front vertical frame members fixed to the base structure and extending upwardly therefrom;

a pair of rear vertical frame members fixed to the base structure and extending upwardly therefrom;

a horizontal member connected between the pair of rear vertical frame members;

a pair of levers having upper ends coupled pivotally to the horizontal member and each lever having a lower end configured to hold at least one removable weight, a tension band, or any combination thereof, wherein the pair of levers are configured to move independently of each other;

a pair of arms, wherein each arm is configured to be raised by a user such that the pair of levers resists the user raising the pair of arms;

a center bench support having a series of adjustment holes, wherein the center bench support is configured to removably receive and support a cantilevered bench above the pair of arms at a desired height;

a pair of horizontal hinge pins, wherein each horizontal hinge pin directly couples a respective elbow to the respective arm of the pair of arms, and wherein a distal end of each arm is configured to rotate in a horizontal plane about the respective horizontal hinge pin;

a pair of slotted pins to removably secure a bar or a pair of handgrips to the pair of arms, wherein the bar or pair of handgrips are configured to rotate in both the horizontal plane and a vertical plane relative to the pair of arms;

each elbow directly disposed at the lower end of each lever and a proximal end of each arm of the pair of arms wherein each elbow having a weight peg; and an upper tension pin fixed to each of the levers and configured to receive a first end of the tension band thereon, and the base structure having a lower tension pin configured to receive a second end of the tension band, wherein the tension band is elastic and configured to resist the user as the user is raising the pair of arms.

* * * * *